United States Patent [19]

De Brey

[11] 4,114,557

[45] Sep. 19, 1978

[54] PARTICLE MONITORING SYSTEM

[76] Inventor: Robert J. De Brey, 1830 E. 42nd St., Minneapolis, Minn.

[21] Appl. No.: 736,467

[22] Filed: Oct. 28, 1976

Related U.S. Application Data

[60] Division of Ser. No. 268,020, Jun. 30, 1972, Pat. No. 3,989,311, which is a continuation-in-part of Ser. No. 37,157, May 14, 1970, Pat. No. 3,674,316.

[51] Int. Cl.[2] ..... G08B 21/00

[52] U.S. Cl. ..... 116/67 R; 73/28

[58] Field of Search ..... 15/339; 73/170 R, 28, 73/194 B, 228, 432 PS; 116/67 R, 112, 117 R; 340/239 R

[56] References Cited

U.S. PATENT DOCUMENTS

| | | | |
|---|---|---|---|
| 1,633,598 | 6/1927 | McClatchie | 73/28 |
| 2,561,763 | 7/1951 | Walters et al. | 73/228 |
| 2,944,250 | 7/1960 | Outt | 73/170 |
| 3,068,694 | 12/1962 | Worswick | 340/239 |
| 3,159,029 | 12/1964 | Ruderman | 73/170 |
| 3,557,616 | 1/1971 | Landon, Jr. et al. | 73/228 |
| 3,600,612 | 8/1971 | Beeken | 73/194 |
| 3,665,226 | 5/1972 | Sinker | 73/194 |
| 3,715,911 | 2/1973 | Chuan | 73/28 |
| 3,805,591 | 4/1974 | Willis et al. | 73/28 |
| 3,841,144 | 10/1974 | Baldwin | 340/239 |
| 3,989,311 | 11/1976 | DeBrey | 15/339 |

FOREIGN PATENT DOCUMENTS

| | | | |
|---|---|---|---|
| 1,254,493 | 11/1971 | Great Britain | 73/432 |

*Primary Examiner*—Herbert Goldstein
*Attorney, Agent, or Firm*—Burd, Braddock & Bartz

[57] ABSTRACT

A particle monitoring apparatus having a particle sensing unit which receives mechanical signals caused by impaction of particles on a sensor and transforms the mechanical signals to an electrical signal related to the amount of particles moving with a fluid, as air. The output signal is used to produce readable information related to the movement of particles in the fluid.

10 Claims, 1 Drawing Figure

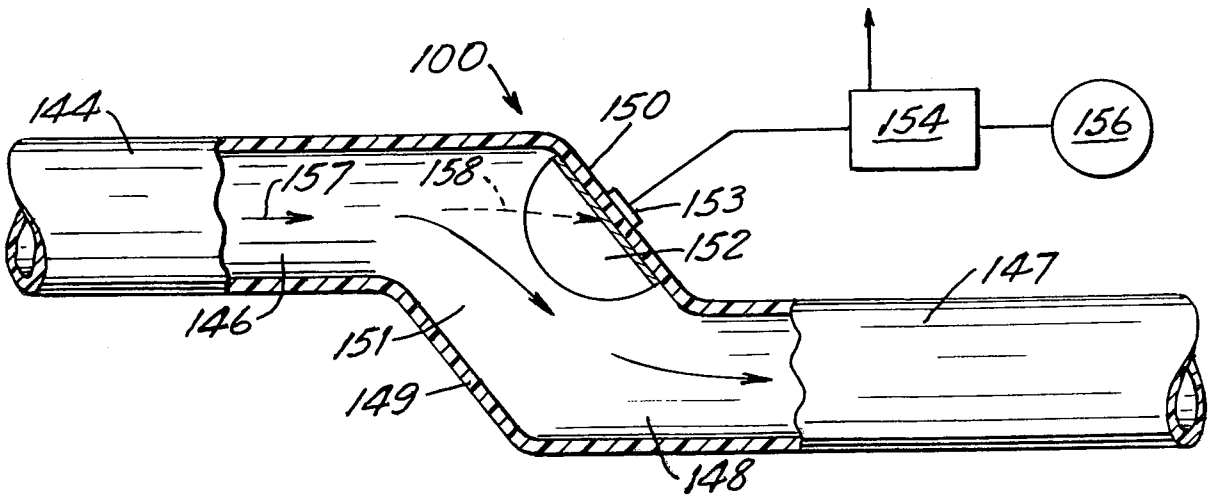
100
144
146
147
148
149
150
151
152
153
154
156
157
158

PARTICLE MONITORING SYSTEM

CROSS REFERENCE TO RELATED APPLICATION

This application is a division of U.S. Pat. application Ser. No. 268,020 filed June 30, 1972, now U.S. Pat. No. 3,989,311. Application Ser. No. 268,020 is a continuation-in-part of U.S. application Ser. No. 37,157, filed May 14, 1970, now U.S. Pat. No. 3,674,316.

BACKGROUND OF THE INVENTION

The measurement of the mass or amount of particles, as dust, powders, dirt, smoke, fine liquids and solid aerosol particles, moving with a fluid, as air, can be accomplished with devices using visual, audio, or electrical parameters. The detection of particles moving in a passage has been accomplished with the use of structure as a probe or screen extended in the passage. These structures interfere with the flow of fluid and material in the passage and also can cause blockage of the passage. Examples of interfering structures in passages are shown by Worswick in U.S. Pat. No. 3,068,696 and Gosbell in British Pat. No. 1,184,073.

Electro-mechanical sensitive material has been used to detect pressure waves resulting from kinetic energy inside the wall of a pipe. Gibney shows in U.S. Pat. No. 2,936,619 a pipe having a plurality of serrations and a transducer which senses the frequencies of the liquid flowing in the pipe over a series of serrations.

SUMMARY OF THE INVENTION

The invention relates to an active monitoring or sensing apparatus operable to provide readable information that is in a direct and reliable relationship to the amount of particles, as dirt, dust, powders, smoke, fine liquids and aerosol particles, moving with a fluid. The particle sensing apparatus has a particle sensing means which includes means upon which particles impinge or hit as they flow with a fluid to produce mechanical signals. The means is located in the flow path in a position so that it does not obstruct the flow of fluid or particles. The sensing means can include a piezoelectric crystal that transforms the mechanical signals to electrical signals. An output means receives the electrical signals and produces readable information related to the impaction of particles on the first means. This information is in direct relationship to the amount of particles moving with the fluid that impinge on the sensing means.

IN THE DRAWINGS

The FIGURE is a diagrammatic view partly sectioned of the particle monitoring apparatus of the invention.

PREFERRED EMBODIMENT OF THE INVENTION

Referring to FIG. 1, there is shown a particle monitoring apparatus, indicated generally at 100, for sensing particles in a moving fluid. Apparatus 100 has an inlet tube 144 having a first passage 146. Located in an offset relation with respect to tube 144 is a second outlet tube 147 having an exit passage 148. A connecting assembly or housing 149 joins adjacent ends of the tubes 144 and 146. The tubes 144 and 147, as well as the connecting assembly, can be made from a single tube having an offset portion. The connecting assembly 149 has an upper back wall 150 in longitudinal alignment with the first passage 146 and an expansion chamber 151 connecting the passages 146 and 148. Chamber 151 has a cross sectional area larger than the cross sectional area of passages 146 and 148. Located on the back wall 150, within chamber 151, is a particle sensor unit 152 capable of detecting impaction signals of particles which may strike the sensor. The sensor unit 152 includes a piezoelectric crystal attached to the wall 150 with a mount or an attaching member 153. Member 153 may be resilient material. An electronic circuit 154 is connected to the crystal to sense and amplify signals established by the impaction of particles on the crystal. The circuit 154 may have means to drive the crystal at its natural frequency. This frequency is changed as particles strike the crystal. The change in crystal frequency is detected by the output device 156 which is operative to provide a readable signal in proportion to the amount of particles that hit the crystal. The output device 156 may be a visual device, as a light, rate meter, digital counter, an audio device, as a speaker, or other sound producing mechanisms or a mechanical device which provides pulsating or vibrating signals. The circuit 154 can include a microphone operable to amplify and transmit the sound of the particles that hit the sensor.

In use, the fluid and the particles carried by the fluid are drawn through the passage 146, as indicated by arrow 157, toward the sensor 152. The air flow changes direction in the chamber 151 toward the exit passage 148. The particles, indicated by broken arrow 158, having momentum, continue in a forward direction and strike the crystal surface. The sensor unit 152 will continuously monitor the particles flowing in the air stream. The electronic circuit 154 provides an output signal which is proportional to the particles sensed. The signal is transmitted to the output device 156 where it is read by the operator.

The drawing and description are directed to the preferred embodiment of the invention. Modifications and alterations in the size, number, shape, materials, sensors and electronic circuits and output reading devices may be made by one skilled in the art without departing from the spirit and scope of the invention.

The embodiments of the invention in which an exclusive property or privilege is claimed are defined as follows:

1. A particle monitoring apparatus for sensing particles in a flowing fluid comprising: first means having a first passage for carrying air and particles, second means having a second passage for carrying air and particles, said second passage being substantially parallel to and offset from the first passage, a housing connecting the first means with the second means, said housing having a chamber in communication with the first passage and second passage and a wall facing the chamber, said wall connecting the first means with the second means and having an angled portion located in general alignment with the longitudinal axis of the first passage, said chamber having a cross sectional area larger than the cross sectional area of either the first or second passage, a particle sensor mounted on said angled portion of said wall, said sensor located in alignment with the first passage so that the particles moving from the first passage are directed toward the sensor, said sensor operable to detect particles that strike the sensor and establish electrical signals related to the number of particles that strike the sensor, said sensor comprising a piezoelectric crystal having a surface exposed to the chamber upon which the particles impinge, said crystal being mounted on the angled portion of said wall and having a shape that conforms to the general shape of the inside of the wall whereby the crystal has a minimum extension into the chamber, an electronic circuit connected to the crystal to sense said electrical signals, and an output device operatively coupled to said circuit whereby said electrical signals are transformed to readable information related to the number of particles that strike the crystal.

2. The apparatus of claim 1 wherein: the first means is an inlet tube and the second means is an outlet tube, said outlet tube being located in an offset relation with respect to the inlet tube, said housing connecting the adjacent ends of said tubes.

3. The apparatus of claim 1 including: a mount for attaching the piezoelectric crystal to the wall.

4. The apparatus of claim 3 wherein: said mount is a resilient member.

5. The apparatus of claim 1 wherein: the first means, second means and housing comprise a one-piece tubular member.

6. A particle monitoring apparatus for sensing particles entrained in a flowing fluid comprising: means having a chamber and an inlet passage and outlet passage open to the chamber for carrying fluid and particles, said inlet passage having a portion thereof substantially parallel to and offset from the outlet passage, said means having an angled wall forming a wall of the chamber facing the inlet passage and generally located in alignment with the longitudinal axis of the inlet passage, a particle sensor mounted on said angled wall in general alignment with the inlet passage for detecting particles that strike the sensor and establishing electrical signals related to the number of particles that strike the sensor, said sensor including sensor means having a surface exposed to the chamber and generally aligned with said inlet passage upon which the particles impinge to establish said electrical signals, said sensor means being mounted on the angled wall with the surface exposed to said chamber and generally aligned with said inlet passage and having a shape that conforms to the general shape of the inside of the wall whereby the sensor means has a minimum particle flow restricting extension into the passage, an electronic circuit connected to said sensor means having a surface to sense electrical signals established by the impaction of particles on the surface, and an output device operatively coupled to said circuit whereby said electrical signals are transformed into readable information related to the number of particles that strike the surface.

7. The apparatus of claim 6 wherein: said chamber has a cross sectional area larger than the cross sectional area of either said inlet passage or outlet passage.

8. The apparatus of claim 6 wherein: said sensor means having a surface includes a piezoelectric crystal.

9. The apparatus of claim 8 including: a mount for attaching the piezoelectric crystal to the wall.

10. The apparatus of claim 9 wherein: said mount is a resilient member.

* * * * *

UNITED STATES PATENT AND TRADEMARK OFFICE

CERTIFICATE OF CORRECTION

PATENT NO. : 4,114,557

DATED : September 19, 1978

INVENTOR(S) : Robert J. De brey

It is certified that error appears in the above-identified patent and that said Letters Patent are hereby corrected as shown below:

On the title page, the name of the inventor is shown as "Robert J. De Brey". This should be -- Robert J. De brey --.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*